United States Patent [19]

Sandström

[11] Patent Number: 4,588,375

[45] Date of Patent: May 13, 1986

[54] OIL BURNER

[76] Inventor: Christer Sandström, Tulevägen 9, S-182 62 Djursholm, Sweden

[21] Appl. No.: 605,056

[22] Filed: Apr. 30, 1984

[60] This application is a continuation of PCT SE 83/00300 filed Aug. 25, 1983, now abandoned.

[51] Int. Cl.[4] ..... F23D 14/62

[52] U.S. Cl. ..... 431/354; 431/115; 431/175; 431/182; 431/186; 239/433

[58] Field of Search ..... 431/174, 175, 181, 182, 431/186, 115, 265, 278, 279, 285, 350, 351, 354; 239/402.5, 418, 420, 424, 428, 433, 434

[56] References Cited

U.S. PATENT DOCUMENTS

| | | | |
|---|---|---|---|
| 729,205 | 5/1903 | Morrissey | 239/434 |
| 2,110,209 | 3/1938 | Engels | 431/173 |
| 2,734,560 | 2/1956 | Harris et al. | 431/285 |
| 3,115,851 | 12/1963 | Ceely | 431/175 |
| 3,361,365 | 1/1968 | Pysart et al. | 239/402.5 |
| 4,052,147 | 10/1977 | Nyegaard | 431/354 |
| 4,140,477 | 2/1979 | Culbertson | 431/350 |
| 4,298,338 | 11/1981 | Babington | 431/175 |
| 4,338,076 | 7/1982 | Straumann et al. | 431/351 |

*Primary Examiner*—Margaret A. Focarino

*Attorney, Agent, or Firm*—McCormick, Paulding and Huber

[57] ABSTRACT

An oil burner of the type comprising a burner housing having several nozzles (16, 17) adapted to introduce pressurized oil (18, 20) and through which housing combustion air (39) is blown for being mixed with the finely distributed oil drops ejected from the nozzles, and in which the burner nozzles (16, 17) are mounted substantially symmetrically with respect to the longitudinal axis (26) of the burner and are mounted angularly to each other, preferably at an angle of 6°-10° and so that the center axis (27, 28) of the oil jets cross each other at or in-front of the outlet (23) of a flame cup (13) of the burner. The burner nozzles are axially displaceable for adapting the oil body ejected from the nozzles so as to extend freely through and touching the outlet (23) of said flame cup (13), and the burner is formed with a turbulator (22) which is axially displaceable in relation to the nozzles (16, 17) so that the oil body from the burners extends freely through a central hole (34) of the turbulator (22). Preferably the flame cup (13) is formed with inlet openings (36) at a place in front of the nozzles (16, 17) for introducing hot combustion gases.

10 Claims, 4 Drawing Figures

OIL BURNER

This application is a continuation of PCT SE 83/00300 filed Aug. 25, 1983, now abandoned.

BACKGROUND OF THE INVENTION

The present invention generally relates to oil burners both for light and heavy heating oils and of the type which comprises a burner housing including several burner nozzles which are fed with pressurized oil, and which burner housing combustion air is blown and is mixed with the finely distributed oil drops which are ejected from the burner nozzles thereby providing a fuel-air mixture. The invention specifically has been developed in connection to oil burners the heating capacity of which can be controlled from full capacity down to a predetermined low heating capacity, but the invention is not restricted to this technical field but may be utilized in all available types of oil burners having several burner nozzles.

Burners having several burner nozzles are previously known. In such burners the nozzles are mounted in a nozzle carrier which in turn is mounted inside a cup in which the oil drops are mixed with incoming air and in which the fuel-air mixture is inflamed at or close to the outlet of said mixture cup. In the previously known burners having several nozzles the said nozzles generally are mounted with the oil jet axis extending axially in relation to the mixture cup so that the oil from all nozzles provide a body of oil drops flowing out of the mixture cup with the periphery of the body of oil drops substantially in contact with the opening of the mixture cup. Such an apparatus works well when operating at full capacity and on a slight reduction of capacity. The best fuel economics and the best operation conditions and the lowest CO-content is obtained if the burner is allowed to operate continuously and with an exactly predetermined mixture of oil and air. When reducing the heat capacity, for instance at hot ambient temperature like in the summer it may be necessary to shut one or more of the burner nozzles to obtain a sufficiently low heating capacity. Since the burner nozzles are mounted as centrally but with the burner axis directed axially the fuel body thereby is placed as centrally in relation to the mixture cup or flame cup and the oil drop body therefore does not fill up said outlet. Further some portion of the introduced combustion air passes the outlet of the flame cup without being mixed with the oil mist and therefore generally a long relationship between air and fuel of the fuel-air mixture is obtained.

The oil burners of the above mentioned type which are known today further are disadvantageous in that a total set value combustion cannot be obtained, possibly depending on an imperfect or unfavourable mixture of the oil mist from the different burner nozzles or that the jets from the different nozzled adversely act on each other. Residues of hydrocarbons and nitrous gases remain after the combustion, and non-burnt oil drops pass the flame and deposit as a fat, wet layer inside the combustion chamber and may cause the formation of carbon, choking of the burner nozzles etc.

SUMMARY

The object of the present invention is to remove the above disadvantages and to provide an oil burner which can be controlled within a larger heat capacity area than previously known burners, and which in front of all can be operated on substantially lower heating capacity than has so far been possible and this without any substantial influence on the efficiency, the remaining amounts of hydrocarbons and nitrous gases.

According to the invention the burner nozzles are mounted substantially symmetrically around the longitudinal axis of the burner and with the nozzles mounted angularly with respect to each other so that the center axis of the oil jets cross each other in front of the outlet of the flame cup. Preferably the burner nozzles are mounted at angles of 6°–10° or preferably 7°–9°. Also preferably the nozzles are mounted so that each single nozzle provides an oil drop body which with the periphery preferably is in contact with the oulet of the flame cup, whereby one or more burner nozzles can be blocked without the disadvantages which appear in the previously known burners of the aforementioned types.

In a further developed embodiment of the invention the flame cup is designed so that the combustion gases are allowed to re-circulate through the flame cup, whereby the combustion gases preheat the oil mist thereby increasing the combustion temperature and giving an improved effeciency. Further advantages of the invention and characteristics thereof will be evident from the following detailed description in which reference will be made to the accompanying drawings.

It is, however, to be understood that the invention is not restricted to the embodiments thereof described and shown in the drawings, but many different modifications may be presented within the scope of the appended claims.

DETAILED DESCRIPTION OF THE PREFERRED EMBODIMENT

Figure 1:
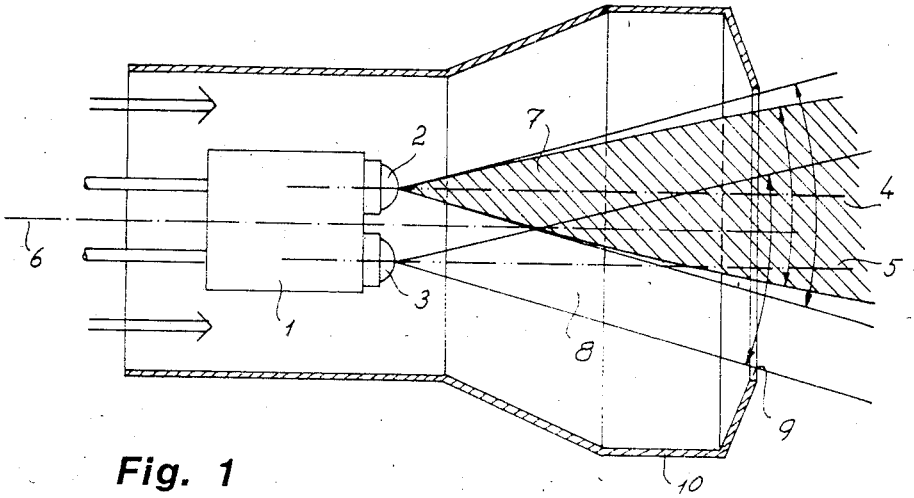
FIG. 1 diagrammatically shows an axial cross-section through an oil burner of a previously known type and having several burner nozzles.
Figure 2:
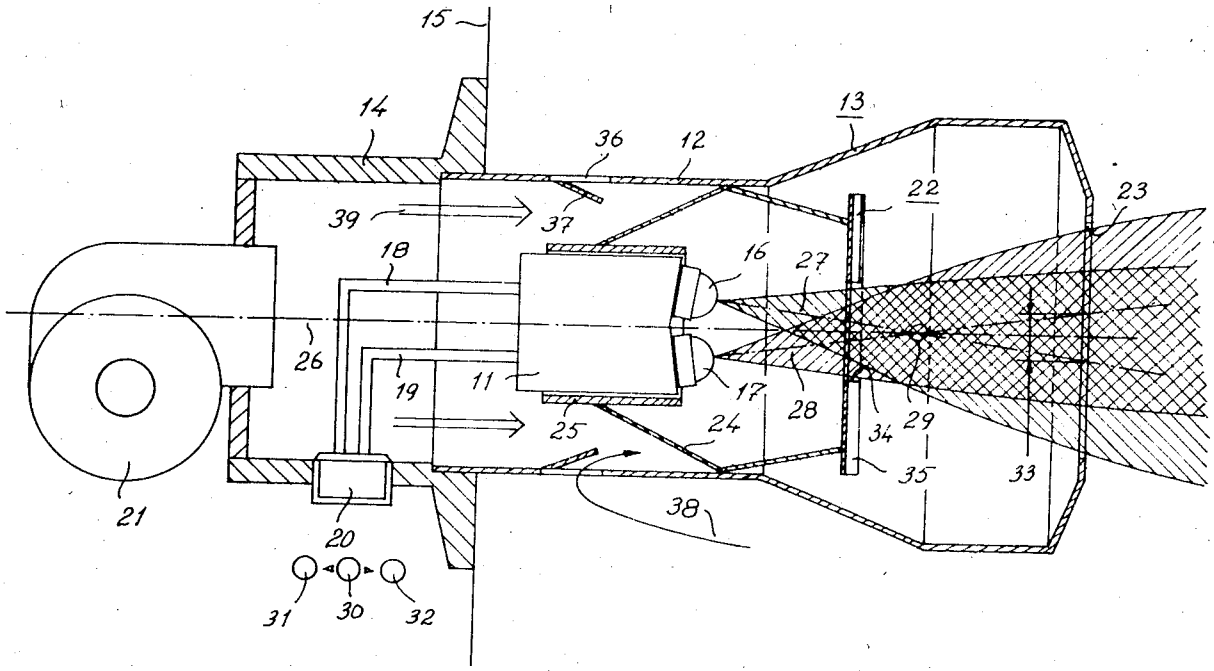
FIG. 2 similarly shows an oil burner according to the invention.

The previously known oil burner illustrated in FIG. 1 comprises a nozzle carrier 1 in which several oil nozzles 2, 3 are mounted so that the center axis 4, 5 of each specific body of oil mist extends axially in relation to the center axis of the burner. It is evident that a closing of one burner nozzle gives an oil body 7 or 8 which does not extend centrally and which at the lower or the upper part of the out let 9 of the flame cup 10 leaves a substantial free opening through which the combustion air may pass. As mentioned above this leads to several disadvantages which are removed by the invention. The oil burner according to the invention illustrated in FIG. 2 is mounted with the nozzle carrier 11 in a throat portion 12 of the flame cup 13. The flame cup 13 in turn is mounted under substantial sealed conditions in the burner housing 14 which is connected to the wall 15 of the boiler. In the nozzle carrier 11 several nozzles 16, 17 are mounted, and each nozzle is connected to a diagrammatically illustrated oil pump 20 over a conduit 18, 19. For the supply of combustion air an air pump 21 is in the conventional way connected with the burner housing 14. Likewise in the conventional way a turbulator 22 is mounted between the nozzle carrier 11 and the outlet 23 of the flame cup 13. The turbulator 22 is mounted axially displacable on the nozzle carrier 11 by means of struts 24 and a slide ring 25. The burner may have two or several burner nozzles 16, 17 which are mounted concentrically in relation to the center axis 26 of the oil burner, and according to the invention the burner nozzles 16 and 17 are mounted at right angles in relation to each other, so that the center axis 27 and 28 of the nozzles 16 and 17 cross each other in a point 29 located at or in front of the outlet 23 of the flame cup 13.

The nozzle carrier 11 with the nozzles 16 and 17 is axially displacable inside the flame cup 13, for instance from a normal position 30 to a rear position 31 or a front position 32. As mentioned above the turbulator 22 likewise is displacable in relation to the nozzle carrier 11. Depending on the scattering angle of the nozzles, the air pressure from the fan 21 etc. the nozzle carrier 11 and the turbulator 22 are adjusted so that the combined oil body from all nozzles substantially completely fill up the outlet 23 of the flame cup 13, i.e. so that the outer periphery of the oil body is in contact with the outlet 23 of the flame cup 13.

Preferably the nozzles are mounted at such angles that the cross point 29 of the center axis of the nozzles is located on such distance in front of the outlet of the flame cup 13 that the center axis 27, 28 in a position online with the outlet 23 fall within a circle 33 having a radius of about 10 mm.

Further the turbulator 22 should be mounted in such position between the nozzles 16 and 17 and the outlet 23 of the flame cup 13 that the total oil body flows freely through the center hole 34 of the turbulator and so that the turbulator wings, which give the combustion air a screw movement, do not prevent a free passage of the oil mist.

In a specific embodiment of the invention the burner is designed so that some parts of the combustion gases are allowed to recirculate and to provide a preheating of the oil mist and the combustion air. For this purpose the throat 12 of the flame cup 13 is formed with a number of inlet openings 36 at a place some distance behind the burner nozzles. Preferably said openings 36 are formed as bent out wings 37 for directing the incoming combustion gases 38.

Figure 3:
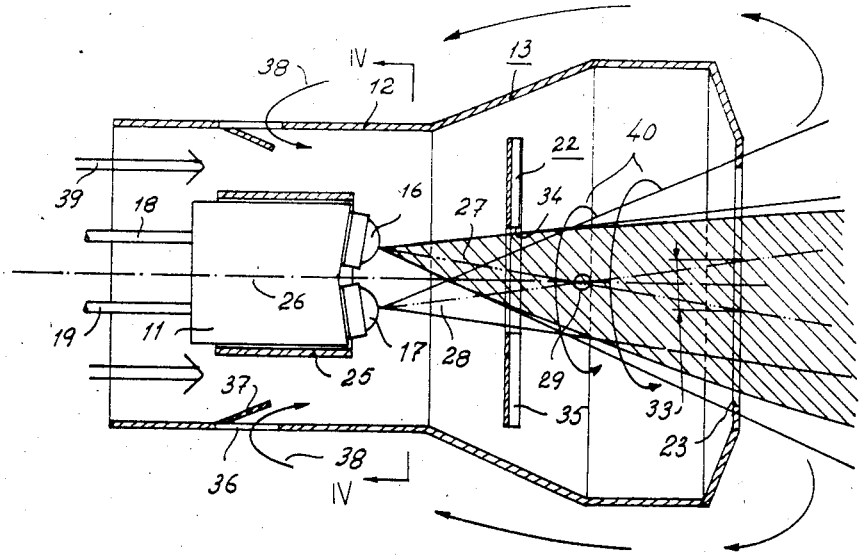
FIG. 3 diagrammatically illustrates the operation of the oil burner according to the invention.

The apparatus according to the invention operates as illustrated in FIG. 3. The combined oil body from the two angularly mounted burner nozzles 16, 17 flows freely through the center hole 34 of the turbulator 22 and touches the outlet 23 of the flame cup 13. It should be noted that the outer portions of the oil body are slightly deflected by the action of the incoming flow of combustion air 39. The combustion air 39 is brought to a circulating movement, as marked with the arrows 40, when passing the turbulator 22 and this movement contributes to giving an intimate mixture of air and oil mist so that an effective fuel-air mixture is obtained, which is inflamed at or close to the outlet of the flame cup 13. The recirculating combustion gases which enter the flame cup throat through the inlet openings 36 provides a preheating both of the combustion air and the oil mist, whereby the flame gets an increased temperature. Such increase of flame temperature gives a more complete combustion and cleaner combustion gases, a lower carbon content and lower stack gas temperatures. At the same time the $CO_2$-content is increased, and thereby the combustion gases become still cleaner.

Figure 4:
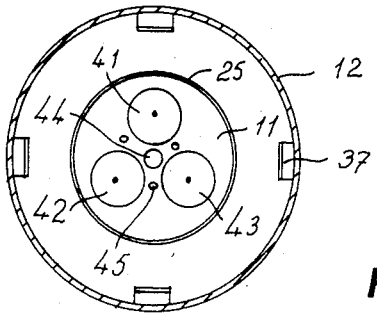
FIG. 4 is a cross-section along line IV–IV in FIG. 3.

FIG. 4 shows a cross-section substantially along IV—IV of FIG. 3 in an embodiment of the invention having three oil nozzles 41, 42 and 43. In order to further improve the intimate mixture of combustion air and oil drops a number of air passage ways are provided axially through the nozzle carrier 11. In the illustrated case there is a relatively large air passage way 44 in the center of the nozzle carrier 11 and three smaller air passage ways 45 located on a circle substantially extending through the center of the nozzles 41–43. The number of air passage ways must be less or higher than the illustrated four passage ways, and the area and location of the passage ways can be changed as requested or found advantageous.

It is evident from FIG. 3, that each oil body 7' and 8' respectively depending on the angular mounting of the burner nozzles 16 and 17 are located nearly centrally in relation to the center axis 26 of the burner in a position online with the outlet 23 of the flame cup 13. If any of the burner nozzles 16 or 17 is closed the oil body 7' or 8' respectively is located practically in the center of the outlet 23 of the flame cup depending on the action of the combustion air 39, and even upon operation with one single nozzle a very good combustion and clean combustion gases is obtained. By the angular mounting according to the invention of the nozzles it has been possible to obtain nearly 30% higher $CO_2$-content of the combustion gases than has been obtained with previously known burners, and thereby a corresponding reduction of the content of the harmful CO-gases has been obtained.

I claim:

1. An oil burner of the high pressure type having a number of burner nozzles (16, 17) mounted in a burner housing (14), each nozzle (16, 17) adapted to eject a concentrated high pressure jet of oil which is decomposed into a body (7', 8') of separate oil drops each body (7', 8') having a central axis (27, 28) extending axially through the center of said nozzles (16, 17), means (21) for having combustion air (39) flow through said burner housing past said burner nozzles (16, 17), said oil burner characterized by:

a flame cup (13) having a larger cross sectional area than the burner housing (14) and a forwardly located outlet opening (23) having a smaller cross sectional area than said housing cross sectional area, said flame cup (13) having a throat (12) directly connected to the burner housing (14) and extending coaxially therewith, the oil drop bodies (7', 8') and the combustion air being mixed to an intimate fuel-air mixture within said flame cup, a turbulator (22) having a center hole (34) for passage therethrough of the oil drop bodies (7', 8') and tubulator wings (35) arranged around said center hole for imparting an axial screw movement to the passing combustion air, said turbulator being located between the burner nozzles (16, 17) and the outlet opening (23) so that the turbulator hole (34) is substantially tangential to the periphery of the oil drop bodies, and the burner nozzles (16, 17) being arranged symmetrically around the longitudinal axis (26) of the burner housing (14) and mounted at an angle relative to one another to cause the central axis (27, 28) of the oil bodies (7', 8') to cross each other substantially along the longitudinal axis (26) at a point between the turbulator (22) and the outlet (23) of the flame cup (13).

2. An oil burner according to claim 1 further characterized by:

a nozzle carrier (11) for holding said burner nozzles (16, 17), said carrier (11) being axially movable inside said flame cup (13) and positioned so that the periphery of the combined oil body from the nozzles (16, 17) and combustion air is substantially tangential to the outlet (23) of the flame cup (13).

3. An oil burner according to claim 1 further characterized by said turbulator (22) being axially movable in said flame cup (13) and positioned so that the combined oil body from the nozzles (16, 17) passes through the center hole (34) of said turbulator (22) substantially without impinging upon the turbulator (22).

4. An oil burner according to claim 1 further characterized by the central axis (27, 28) associated with a respective nozzle (16, 17) and oil body (7', 8') intersecting at a cross point (29) located within said flame cup (13) and at a predetermined position in front of said outlet (23).

5. An oil burner according to claim 4 further characterized by said cross point (29) predetermined position being located to cause said central axis (27, 28) intersecting a plane extending through said opening (23) in a direction substantially perpendicular to said longitudinal axis (26) to pass through said opening (23) within a circle having a diameter of about 10 mm.

6. An oil burner according to claim 1 characterized by said burner nozzle mounting angle with respect to said longitudinal axis (26) is between 6° and 10°.

7. An oil burner according to claim 1 characterized by said burner nozzle mounting angle with respect to said longitudinal axis (26) is between 7° and 8°.

8. An oil burner according to claim 1 further characterized by said throat (12) having a number of openings (36) arranged circumferentially around said throat for recirculating a portion of hot combustion gases, said openings (36) being located rearward of said burner nozzles (16, 17).

9. An oil burner according to claim 1 characterized by:

a nozzle carrier (11) having a number of channels (41, 42, 43) axially extending through said carrier for holding said burner nozzles and permitting the passage of combustion air, said channels being radially arranged around a center point of said carrier (11).

10. An oil burner according to claim 9 further characterized by said nozzle carrier (11) including a first passageway (44) extending axially through the carrier center and at least one second passageway (45) located between each adjacent pair of channels (41, 42, 43), said central passageway (44) being substantially larger than said second passageway (45).

* * * * *